US006166634A

United States Patent [19]

Dean

[11] Patent Number: 6,166,634

[45] Date of Patent: Dec. 26, 2000

[54] GARAGE DOOR STATUS SIGNALLING DEVICE

[76] Inventor: John A. Dean, 565 S. Brea Canyon Rd., #E, Walnut, Calif. 91789

[21] Appl. No.: 09/208,985

[22] Filed: Dec. 11, 1998

[51] Int. Cl.[7] ..... G08B 23/00

[52] U.S. Cl. ..... 340/545.1; 340/309.15; 340/539; 340/693.1

[58] Field of Search ..... 340/545.1, 539, 340/309.15, 693.1, 691.8, 331, 326, 329

[56] References Cited

U.S. PATENT DOCUMENTS

| | | | |
|---|---|---|---|
| 4,124,847 | 11/1978 | Cashman | 340/548 |
| 4,583,081 | 4/1986 | Schmitz | 340/686.6 |
| 4,954,810 | 9/1990 | Llewellyn | 340/692 X |
| 5,402,105 | 3/1995 | Doyle et al. | 340/539 |
| 5,689,236 | 11/1997 | Kister | 340/545.1 |

FOREIGN PATENT DOCUMENTS

| | | | |
|---|---|---|---|
| 580 003 | 1/1994 | European Pat. Off. | 340/FOR 100 |

*Primary Examiner*—Thomas Mullen
*Attorney, Agent, or Firm*—Robert M. Sperry

[57] ABSTRACT

An improved garage door signalling device comprising a switch actuable upon opening of the garage door, a transmitter actuable by said switch to transmit a signal indicating that the door is open, a receiver located at a desired location remote from the garage door providing an audiovisual warning when the garage door is not in the closed position, and means for energizing the garage door signalling device.

7 Claims, 1 Drawing Sheet

GARAGE DOOR STATUS SIGNALLING DEVICE

FIELD OF INVENTION

This invention relates to garage doors and the like and is particularly directed to means for signalling when the garage door is open.

PRIOR ART

In recent years it has become increasingly popular to have power-driven doors for garages and the like. Unfortunately, it often happens that the garage is so located that it cannot be seen from a residence or guard house, which means that the door can be left open, inadvertently or on purpose, without the knowledge of the home owner or guard, leaving the location highly susceptible to robbery or other crimes. To overcome this problem, it has been proposed to provide a signal when the door was in motion. However, these devices serve to alert persons standing close to the door that it is opening so that they can avoid being struck by the moving door. However, once the door is open or closed, these devices send no further signal. Consequently, if the door is left open, no reminder signal will be sent. Still other garage door signalling devices have been complex and expensive to purchase and install. A search in the United States Patent Office has revealed the following:

| U.S. PAT. NO. | INVENTOR | ISSUED |
|---|---|---|
| 5,402,105 | M. P. Doyle et al | Mar. 28, 1995 |
| 4,954,810 | T. E. Llewellyn | Sep. 4, 1990 |
| 4,583,081 | C. J. Schmitz | Apr. 15, 1986 |
| 4,124,847 | R. D. Cashman | Nov. 7, 1978 |

Each of these references is subject to one or more of the disadvantages discussed above. Thus, none of the prior art garage door signalling devices has been entirely satisfactory.

BRIEF SUMMARY AND OBJECTS OF INVENTION

These disadvantages of the prior art are overcome with the present invention and an improved garage door signalling device is provided which provides clear audio and visual signals, at a desired remote location, when the garage door is opened and which provides periodic reminder signals as long as the garage door remains in the open position.

These advantages of the present invention are preferably attained by providing an improved garage door signalling device comprising a switch actuable upon opening of the garage door, a transmitter actuable by said switch to transmit a signal indicating that the door is open, a receiver located at a desired location remote from the garage door and means for energizing the garage door signalling device.

Accordingly, it is an object of the present invention to provide an improved garage door signalling device.

Another object of the present invention is to provide an improved garage door signalling device which is simple and inexpensive to purchase and install.

An additional object of the present invention is to provide an improved garage door signalling device which provides clear audio and visual signals, at a desired remote location, when the garage door is opened.

A further object of the present invention is to provide an improved garage door signalling device which provides continual visual and periodic audio reminder signals as long as the garage door remains in the open position.

A specific object of the present invention is to provide an improved garage door signalling device comprising a switch actuable upon opening of the garage door, a transmitter actuable by said switch to transmit a signal indicating that the door is open, a receiver located at a desired location remote from the garage door and means for energizing the garage door signalling device.

These and other objects and features of the present invention will be apparent from the following detailed description, taken with reference to the figures of the accompanying drawing.

DETAILED DESCRIPTION OF THE INVENTION

Figure 1:
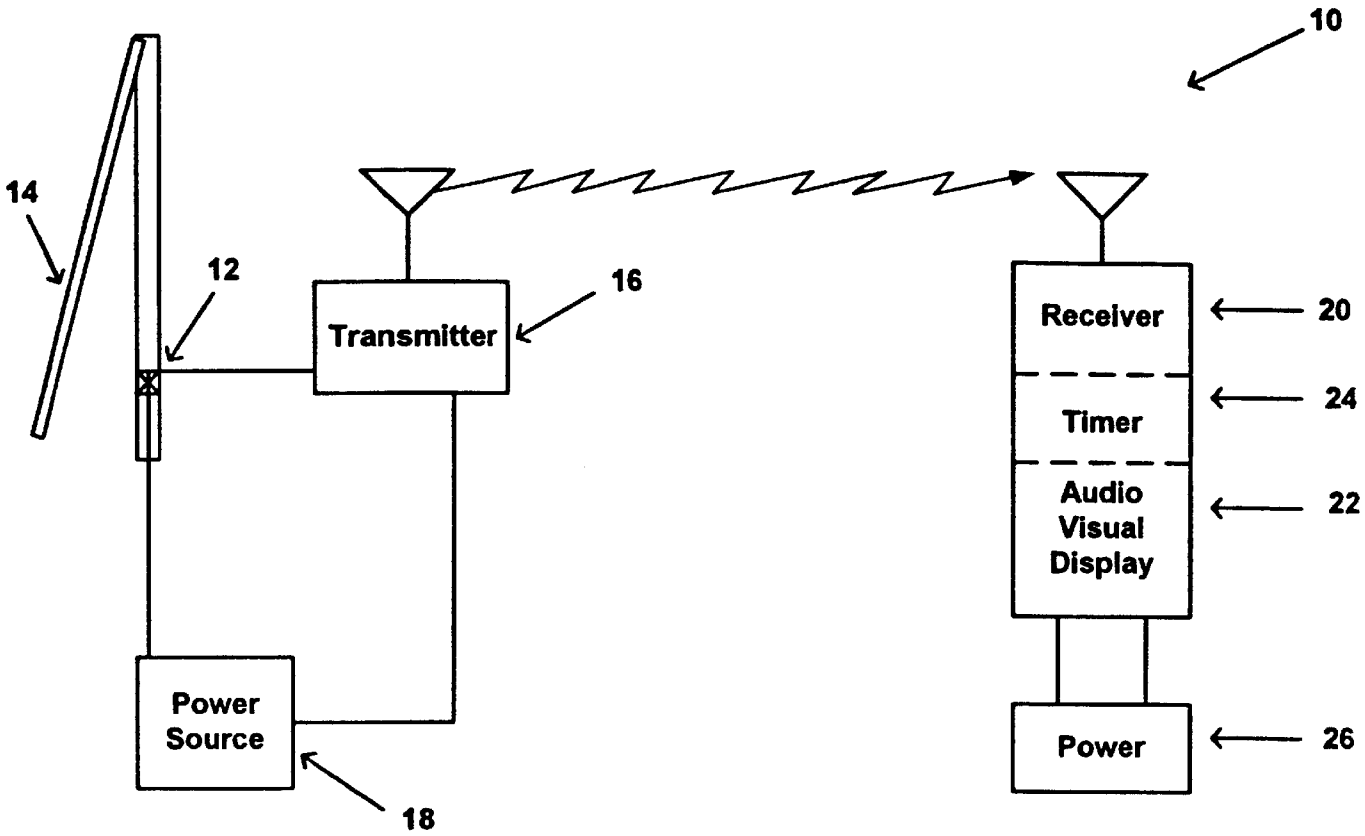
FIG. 1 is a diagrammatic representation of a garage door signalling device embodying the present invention.

In that form of the present invention chosen for purposes of illustration, FIG. 1 shows a garage door signalling device, indicated generally at 10, comprising a switch 12 mounted adjacent the garage door 14 and operable upon opening of the garage door 14 to complete an electrical circuit through transmitter 16 and power source 18. The power source 18 may be connected to the line current of the house or garage or may be self-contained, as by batteries or the like and may include suitable transformers or the like to convert 120 v. A.C. current to 12 v. D.C. In any event, when the garage door 14 is opened, switch 12 activates the transformer 16 which broadcasts a signal to a suitable receiver 20 located at a desired location remote from the garage door 14, such as in a residence, guard station or the like. Upon receipt of the signal from transmitter 16, the received 20 activates audio and visual means 22 to generate audio and/or visual signals to alert persons in the residence or guard station that the garage door 14 is open. Also, receiver 20 starts a timer 24 which measures a desired time interval and, upon completion of the time interval, samples the receiver 20 to determine whether the receiver 20 is still receiving signals from transmitter 16. If signals are still being received, the timer 24 triggers audiovisual means 22 to again generate the audio and/or visual warning signals. The timer 24 also resets itself to again measure the desired time interval and repeats the steps above to produce periodic audio and/or visual warning signals to alert persons in the residence or guard station that the garage door 14 is still open. When the garage door 14 is closed, switch 12 breaks the electrical circuit through transmitter 16, causing transmitter 16 to discontinue sending signals to the receiver 20. Consequently, when timer 24 samples the receiver 20, no signal will be present and the timer 24 will cease operation until receiver 20 again receives a signal from transmitter 16. Power source 26 for receiver 20, audiovisual means 22 and timer 24 may be provided from line current within the residence or guard station or may be supplied by batteries, if desired.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A garage door signaling device comprising:

a switch actuable upon opening of the garage door, a transmitter actuable by said switch to transmit a signal indicating that the door is open, a receiver located at a desired location remote from the garage door, means for energizing the garage door signalling device comprising a first power source connectable by said switch to energize said transmitter, and a second power source energizing said receiver, said first power source being connected to line current in the garage and said second power source being connected to line current at said remote location.

2. The device of claim 1 further comprising:

audiovisual means actuable by said receiver in response to receipt of a signal from said transmitter to provide a warning signal indicating that said garage door is open.

3. The device of claim 1 wherein:

said first power source contains batteries.

4. The device of claim 1 wherein:

said second power source contains batteries.

5. The device of claim 1 wherein:

said first and second power sources each contain batteries.

6. A garage door signaling device comprising:

a switch actuable upon opening of the garage door, a transmitter actuable by said switch to transmit a signal indicating that the door is open, a receiver located at a desired location remote from the garage door, means for energizing the garage door signalling device, and audiovisual means actuable by said receiver in response to receipt of a signal from said transmitter to provide a warning signal indicating that said garage door is open, said receiver including a timer actuable by said receiver upon receipt of a signal from said transmitter to trigger said audiovisual means and after a desired time interval to sample said receiver to determine whether said receiver is still receiving signals from said transmitter.

7. The device of claim 6 wherein:

said timer repeats said sampling and triggering operations as long as said receiver is receiving signals from said transmitter to provide periodic signals warning that said garage door is still open.

* * * * *